US007325651B2

(12) United States Patent
Kikuchi et al.

(10) Patent No.: US 7,325,651 B2
(45) Date of Patent: Feb. 5, 2008

(54) MOTORCYCLE EXHAUST SYSTEM

(75) Inventors: Hiroyuki Kikuchi, Kobe (JP); Atsushi Eto, Kakogawa (JP); Hideo Beppu, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 116 days.

(21) Appl. No.: 11/063,146

(22) Filed: Feb. 22, 2005

(65) Prior Publication Data

US 2005/0189166 A1 Sep. 1, 2005

(30) Foreign Application Priority Data

Feb. 27, 2004 (JP) ..... 2004-053281

(51) Int. Cl.
*F02D 9/08* (2006.01)

(52) U.S. Cl. ..... 181/237; 181/236; 181/227; 181/254; 181/228; 180/309; 180/296; 180/89.2; 180/68

(58) Field of Classification Search ..... 181/237, 181/236, 227, 254, 228, 251, 268, 269, 259, 181/272, 275, 255; 180/309, 296, 89.2, 68
See application file for complete search history.

(56) References Cited

U.S. PATENT DOCUMENTS 1,709,426 A * 4/1929 Beery ..... 181/254
5,183,130 A * 2/1993 Nakamura et al. ..... 180/219
6,334,501 B1 * 1/2002 Kawamoto ..... 180/309
6,546,722 B2 * 4/2003 Sagara et al. ..... 60/324
6,598,390 B2 * 7/2003 Chang ..... 60/323
6,675,933 B2 * 1/2004 Yamaguchi ..... 181/227
6,857,497 B2 * 2/2005 Sato et al. ..... 180/312
6,941,751 B2 * 9/2005 Yamamoto et al. ..... 60/322

(Continued)

FOREIGN PATENT DOCUMENTS

EP 1 464 824 A1 10/2004

(Continued)

OTHER PUBLICATIONS

Bridgestone: "Bridgestone Battlax 'BT 014' erfolgreich auf Honda CBR 1000 Vorgestellt" Online! Jan. 8, 2004, XP002328889 Retrieved from the Internet: URL: www.bridgestone.de/articles.asp?ID=50426> 'retrieved on May 19, 2005.

(Continued)

*Primary Examiner*—Lincoln Donovan
*Assistant Examiner*—Forrest Phillips

(57) ABSTRACT

To provide a motorcycle exhaust system, which is less susceptible to the elevated temperature of the exhaust gases and vibrations induced by the motorcycle combustion engine (E) and in which the sectional area of the exhaust passage can be properly adjusted independence on the operating condition of the motorcycle combustion engine (E), the motorcycle exhaust system includes a motorcycle combustion engine (E) mounted at a location generally intermediate between front and rear wheels (3 and 9), an exhaust passage fluidly connected at one end with an exhaust port of the motorcycle combustion engine (E), a silencer (17) fluidly connected with the opposite end of the exhaust passage and supported by the motorcycle frame structure (FR) at a location generally above the rear wheel (9); and an exhaust control valve (24) disposed in an inlet of the silencer (17) for variably adjusting the sectional area of the exhaust passage.

15 Claims, 5 Drawing Sheets

U.S. PATENT DOCUMENTS

| | | | | |
|---|---|---|---|---|
| 6,968,922 | B2 * | 11/2005 | Kawamata et al. | 181/231 |
| 2002/0050415 | A1 | 5/2002 | Kawamoto | |
| 2005/0061580 | A1 * | 3/2005 | Wiemeler et al. | 181/254 |

FOREIGN PATENT DOCUMENTS

| | | | |
|---|---|---|---|
| JP | 63-215825 | | 9/1988 |
| JP | 04-292534 | | 10/1992 |
| JP | 10-238334 | * | 9/1998 |

OTHER PUBLICATIONS

Honda Motors Europe (North) GMBH: "Fireblade- Geballte Rennsportkompetenz" 'Online! Feb. 2004, XP002328929 Retrieved from the Internet: URL:www.ghbiker.de/motorrad/sc57/presse/de_mc_br_fireblade_2004.pdf> 'retrieved on May 19, 2005.

Trevor Hedge: "Honda CBR 1000 RR Fireblade—Review—p. 2" 'Online! Jul. 13, 2004, XP002328890 Retrieved from the Internet URL:http://66.132.214.20/Testing/Honda/2004_cbr1000rr_fireblade/fireblade_page2.htm> 'retrieved on May 19, 2005.

Honda Japan: "CBR 1000 RR—Styling (3)" 'Online! Apr. 2004, XP002328891 Retrieved from the Internet: URL:www.honda.co.jp/factbook/motor/cbr1000rr/200404/005.html> 'retrieved on May 20, 2005.

Honda Japan: "CBR 1000 RR—Engine (6)" 'Online! Apr. 2004,XP002328892 Retrieved from the Internet: URL:www.honda.co.jp/factbook/motor/cbr1000/200404/012.html> 'retrieved on May 20, 2005.

* cited by examiner

MOTORCYCLE EXHAUST SYSTEM

BACKGROUND OF THE INVENTION

1. Field of the Invention

The present invention generally relates to a motorcycle exhaust system and, more particularly, to the motorcycle exhaust system designed to vary the sectional area of an exhaust passage in dependence on the operating condition of the motorcycle combustion engine.

2. Description of the Prior Art

It has hitherto been well known that the conventional motorcycles make use of an exhaust system designed to properly change the sectional area of an exhaust passage in dependence on the operating condition of the motorcycle combustion engine. Specifically, the Japanese Laid-open Patent Publication No. 4-292534, for example, discloses the use of an exhaust control valve capable of continuously changing the opening of the exhaust passage, which valve is disposed at a location upstream of the silencer or muffler.

In the conventional exhaust system disclosed in the above mentioned patent publication, however, the silencer is positioned at a location laterally of the motorcycle rear wheel and relatively close to the motorcycle combustion engine, the distance from the exhaust port of the combustion engine to the exhaust control valve is so small that the exhaust control valve tends to be adversely affected by an elevated temperature of the exhaust gases as the exhaust gases flow through the exhaust control valve. Also, since the exhaust control valve is positioned close to the combustion engine as described above, the exhaust control valve is also susceptible to vibrations induced by the combustion engine.

In addition, since a considerable thermal expansion occurs as a result of the elevated temperature of the exhaust gases, a limitation is encountered to fill up the valve clearance of the exhaust control valve at a low temperature, resulting in difficulty in securing the required valve clearance. Moreover, considering that the output performance of the motorcycle combustion engine is controlled relying on the valve opening of the exhaust control valve, it is not easy to accomplish an appropriate engine control. Furthermore, demands have been made to improve the appearance of the exhaust system since the exhaust control valve and concomitant accessories including, for example, an actuator are exposed bare to the outside.

SUMMARY OF THE INVENTION

In view of the foregoing, the present invention is intended to provide an improved motorcycle exhaust system, which is less susceptible to the elevated temperature of the exhaust gases and vibrations induced by the motorcycle combustion engine and in which the sectional area of the exhaust passage can be properly adjusted in dependence on the operating condition of the motorcycle combustion engine.

In order to accomplish the foregoing object of the present invention, there is provided a motorcycle exhaust system, which includes a motorcycle combustion engine mounted on a motorcycle frame structure at a location generally intermediate between front and rear wheels, an exhaust passage fluidly connected at one end with an exhaust port of the motorcycle combustion engine, a silencer disposed at the opposite end of the exhaust passage and supported by the motorcycle frame structure at a location generally above the rear wheel, and an exhaust control valve disposed in an inlet of the silencer for variably adjusting the sectional area of the exhaust passage.

According to the present invention, since the silencer is supported above the rear wheel, the exhaust passage can have an increased length from the exhaust port of the motorcycle combustion engine to the silencer as compared with that of the conventional motorcycle exhaust system in which the silencer is disposed laterally of the rear wheel. Because of the substantial length of the exhaust passage, the high temperature heat of the exhaust gas within the exhaust passage can be released by the time when they reach the inlet of the silencer and, hence, the exhaust control valve disposed at the inlet of the silencer can be substantially immune from being adversely affected by the elevated temperature of the exhaust gases.

Also, since according to the present invention the silencer is supported by a rear portion of the motorcycle frame structure at a location above the motorcycle rear wheel and distant from the combustion engine, the silencer and the exhaust control valve disposed at the inlet of the silencer would hardly be affected by the vibrations of the motorcycle combustion engine.

In a preferred embodiment of the present invention, upper and lateral outer regions of the exhaust control valve is covered by a tail fairling covering a rear portion of the motorcycle frame structure. The use of the tail fairling is particularly advantageous in that the exhaust control valve can advantageously be concealed from the outside.

In another preferred embodiment of the present invention, an actuator for driving the exhaust control valve is disposed at a location below a motorcycle seat assembly. The disposition of the actuator below the motorcycle seat assembly allows the actuator to be concealed from the outside by the seat assembly as is the case with the exhaust control valve and is therefore invisible from the outside, resulting in an appealing appearance. Such disposition of the actuator also allows the distance between the actuator and the exhaust control valve to be reduced and, consequently, a drive transmitting member such as a cable wire connecting between the actuator and the exhaust control valve may have a reduced length, resulting in reduction of the weight and the cost of manufacture.

In addition, reduction in length of the drive transmitting member simplifies the placement of such drive transmitting member, accompanied by increase of the assemblability and, also, improvement in precision of the length of the drive transmitting member and the dimension, which is accompanied by increase of the precision of the valve clearance of the exhaust control valve and the response in selective opening and closing of the exhaust control valve. Yet, the disposition of the actuator below the motorcycle seat assembly results in the actuator held distant from the motorcycle combustion engine, making it hard for the vibrations of the combustion engine to be transmitted to the actuator. Accordingly, as the drive transmitting member drivingly connecting between the actuator and the exhaust control valve a link mechanism can advantageously and conveniently employed, resulting in further increase of the response in selective opening and closing of the exhaust control valve.

Preferably, the exhaust control valve may be employed in the form of a butterfly valve having an excellent response. In this case, the silencer referred to above may have a plurality of expansion chambers including a first expansion chamber defined upstream of the silencer with respect to the direction of flow of the exhaust gases and a second expansion chamber defined downstream of the silencer, and the exhaust control valve is disposed forwardly of an inlet of a first connecting passage communicating between the first and second expansion chambers so as to face towards the inlet of the first connecting passage. The butterfly valve may include a valve member rotatable about a vertical axis.

According to this further preferred embodiment, since the valve member of the exhaust control valve moves angularly about the vertical axis, the direction of flow of the exhaust gases ready to enter into the expansion chambers of the silencer can be diverted left and right at the entrance to the silencer. In such case, if the valve member of the exhaust control valve is held at a fully closed position, at which the sectional area of the exhaust passage is set to a minimum opening, the exhaust gases within the exhaust passage can flow at a high velocity and, therefore, the exhaust gases so diverted can flow from the first connecting passage, positioned rearwardly of the exhaust control valve, to the second expansion chamber without being diffused into the first expansion chamber. Accordingly, the output of the motorcycle combustion engine during for example, a low load low speed operating condition can advantageously be increased.

On the other hand, if the valve member is held at a full open position at which the sectional area of the exhaust passage is set to a maximum opening, the exhaust gases can flow mainly into the first expansion chamber, positioned immediately downstream of the exhaust control valve, and then into the second expansion chamber by way of the first connecting passage. Accordingly, noises tending to occur during the high load, high speed operating condition of the motorcycle combustion chamber can advantageously be reduced. Also, the output performance of the motorcycle combustion engine can advantageously be controlled optionally (properly) by changing the relative positioning between the first connecting passage and the exhaust control valve.

The exhaust system of the present invention may include a valve controller for controlling the exhaust control valve in dependence on at least the number of revolutions of the motorcycle combustion engine and the opening of a throttle valve. Using the valve controller, the opening of the exhaust control valve can properly be set to a value appropriate to the flow of the exhaust gas and, therefore, the output of the motorcycle combustion engine and reduction of the exhaust gas noise can feasibly be balanced.

BRIEF DESCRIPTION OF THE DRAWINGS

In any event, the present invention will become more clearly understood from the following description of a preferred embodiment thereof, when taken in conjunction with the accompanying drawings. However, the embodiment and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENT

Figure 1:
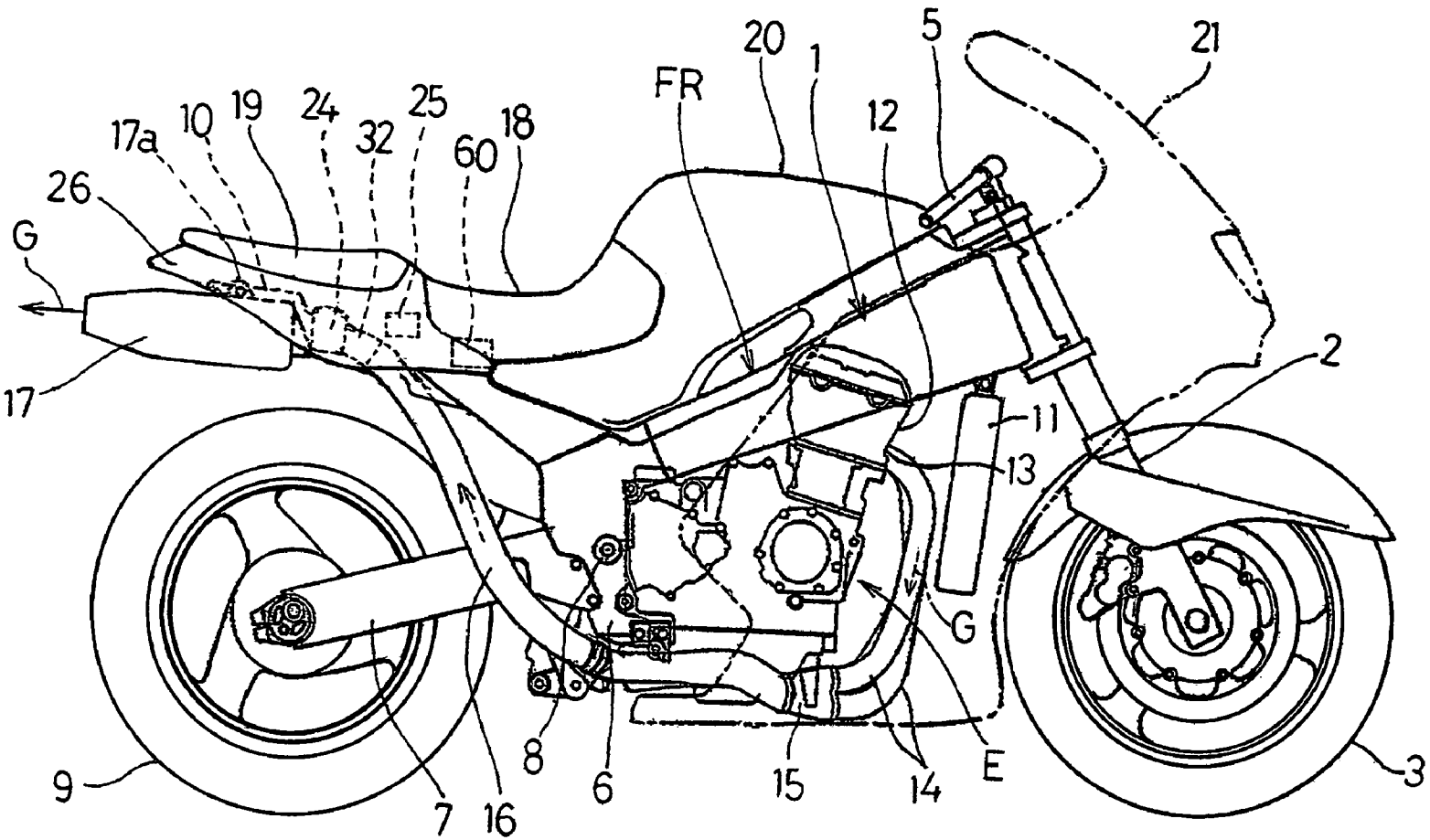
FIG. 1 is a side view of a motorcycle equipped with an exhaust system according to a preferred embodiment of the present invention.

Hereinafter, a preferred embodiment of the present invention will be described in detail with reference to the accompanying drawings. Referring first to FIG. 1, showing in a side view a motorcycle equipped with an exhaust system according to the preferred embodiment of the present invention, the motorcycle shown therein has a motorcycle frame structure FR including a main frame 1 forming a front half of the motorcycle frame structure FR. The main frame 1 has a front fork 2 supported thereby, with a front wheel 2 rotatably carried by a lower end of the front fork 2. A handlebar 5 is fixedly mounted on an upper end of the front fork 2 for rotation together therewith.

A swingarm bracket 6 is formed in each of left and right rear lower portions of the main frame 1, and a swingarm 7 is carried by the swingarm brackets 6 through a pivot shaft 8 at a front end portion of the swingarm 7 for movement up and down about the pivot shaft 8. A rear drive wheel 9 is rotatably supported by the swingarm 7 at a rear end portion thereof. A rear portion of the main frame 1 is connected with left and right seat rails 10, which form a rear half of the motorcycle frame structure FR.

A motorcycle engine E, such as a multi-cylinder four-cycle internal combustion engine, is supported by the main frame 1 at a generally lower intermediate portion thereof, with a radiator 11 positioned forwardly of the engine E with respect to the direction of forward run of the motorcycle. This engine E has an upper front portion formed with exhaust ports 13 defined in an cylinder head thereof in communication with the respective engine cylinders and fluidly connected with exhaust tubes 14. Those exhaust tubes 14 are fluidly connected with a manifold 15, which is in turn fluidly connected with a joint pipe 16 positioned downstream of the manifold 15 with respect to the direction of flow of exhaust gases G from the exhaust ports 13 to the atmosphere. A silencer or muffler 17 is fluidly connected with a downstream end of the joint pipe 16 through a silencer inlet pipe 32 and positioned above the rear wheel 9 and below the seat rails 10 while aligned with the longitudinal axis of the motorcycle frame structure FR. These members 14-17 and 32 together form an exhaust passage for the exhaust gas G.

A driver's seat 18 and a fellow passenger's seat 19 are mounted on the seat rails 10 so as to straddle between those seat rails 10 through suitable fixtures (not shown), and a fuel tank 20 is mounted on an upper portion of the main frame 1 at a location between the handlebar 5 and the driver's seat 18. A front fairing or cowling 21 made of a synthetic resin is mounted on the motorcycle frame structure FR so as to cover a region extending from a front portion of the handlebar 5 to opposite lateral sides of the front portion of the motorcycle frame structure FR, with opposite side portions of the motorcycle combustion engine E covered by opposite rear wing portions of the front fairing 21.

Figure 2:
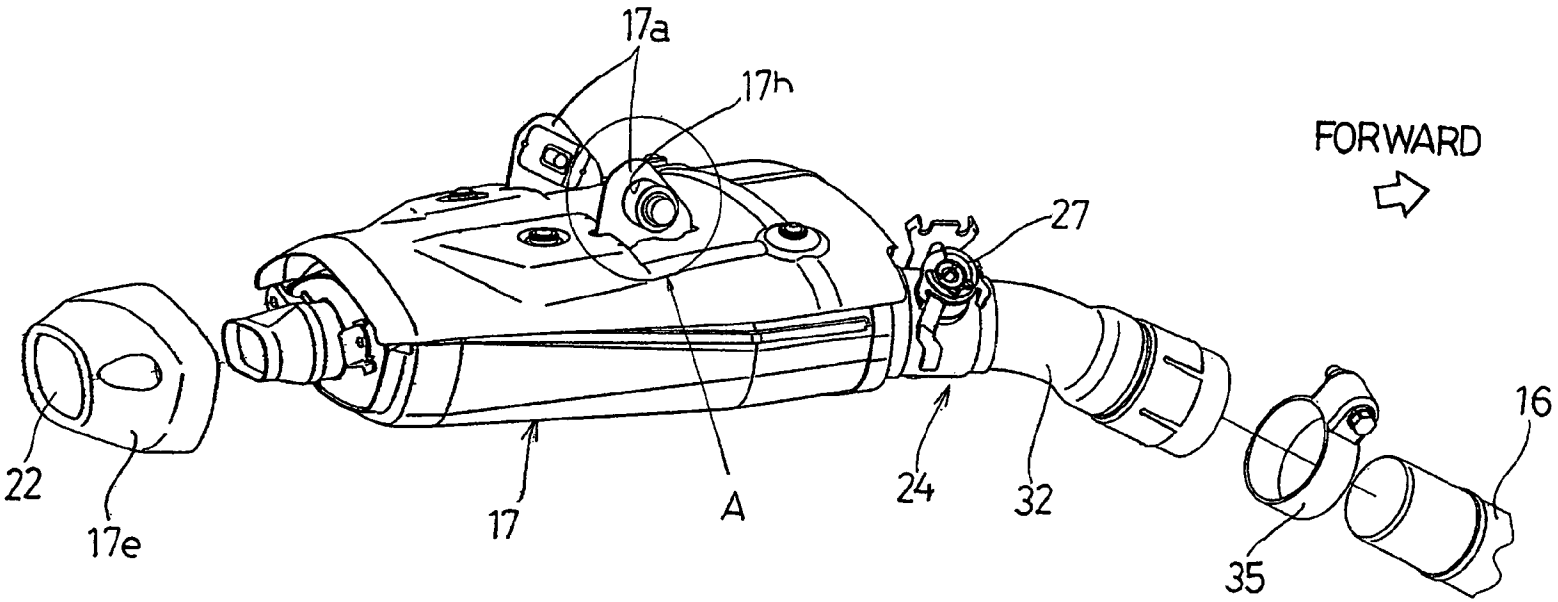
FIG. 2 is an exploded view, showing a silencer employed in the motorcycle shown in FIG. 1.

As best shown in FIG. 2, the silencer 17 has an upper surface portion formed with left and right flanges 17*a* and 17*a* so as to protrude generally upwardly therefrom, and each of those flanges 17*a* is formed with a mounting hole 17*b*. This silencer 17 has an inlet fluidly connected with the silencer inlet pipe 32, which is in turn fluidly connected with the joint pipe 16 by means of a connecting member 35. An exhaust control valve 24 for varying the sectional area of the exhaust passage is provided in the silencer inlet pipe 32. In consideration of the appearance of the silencer 17, a rounded outlet cover 17*e* having an opening 22 is fitted to an outlet portion of the silencer 17.

Figure 3:
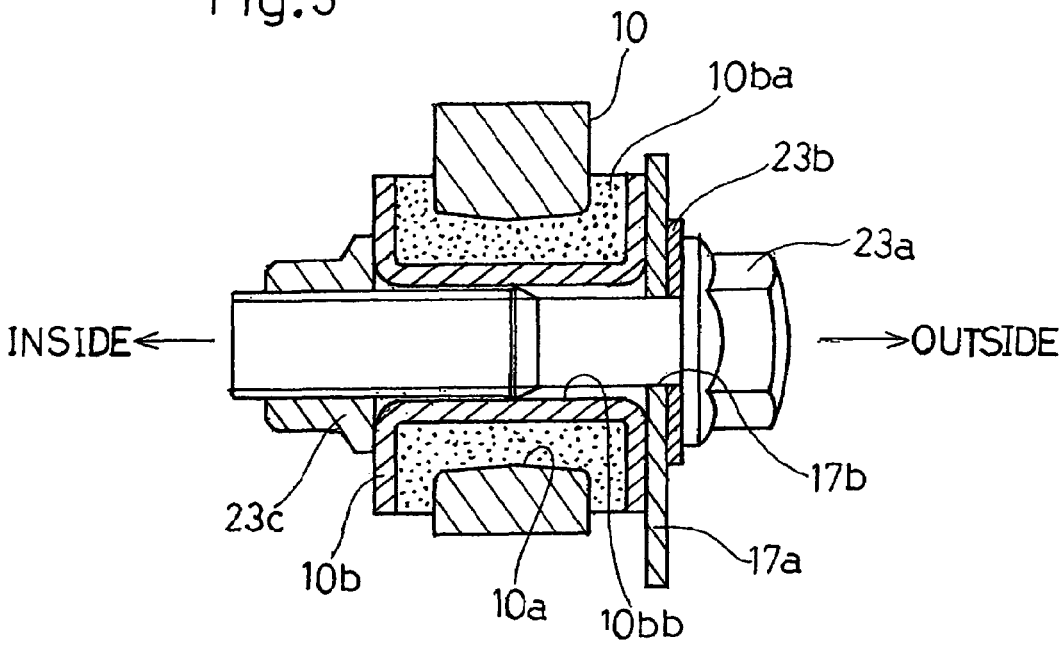
FIG. 3 is a longitudinal sectional view, on an enlarged scale, of a portion of the silencer that is encompassed by the circle shown by A in FIG. 2.

The manner in which the silencer 17 is supported is shown in FIG. 3. As shown therein, each of the seat rails 10 has a mounting hole 10*a* defined therein and an annular collar 10*b*. The annular collar 10*b* has a center hole 10*bb*. A vibration isolating damper 10*ba* built in the collar 10*b* is mounted in the mounting hole 10*a* in each of the seat rail 10. The silencer 17 is supported by the seat rails 10 in a fashion suspended therefrom, by aligning the mounting holes 17*b* in the respective flanges 17*a* with the center holes 10*bb* of the respective annular collars 10*b*, passing corresponding bolts 23*a* externally through the aligned holes 17*b* and 10*bb* through washers 23*b* and finally fastening nuts 23*c* firmly onto the respective bolts 23*a* from a space between the seat rails 10.

Figure 4:
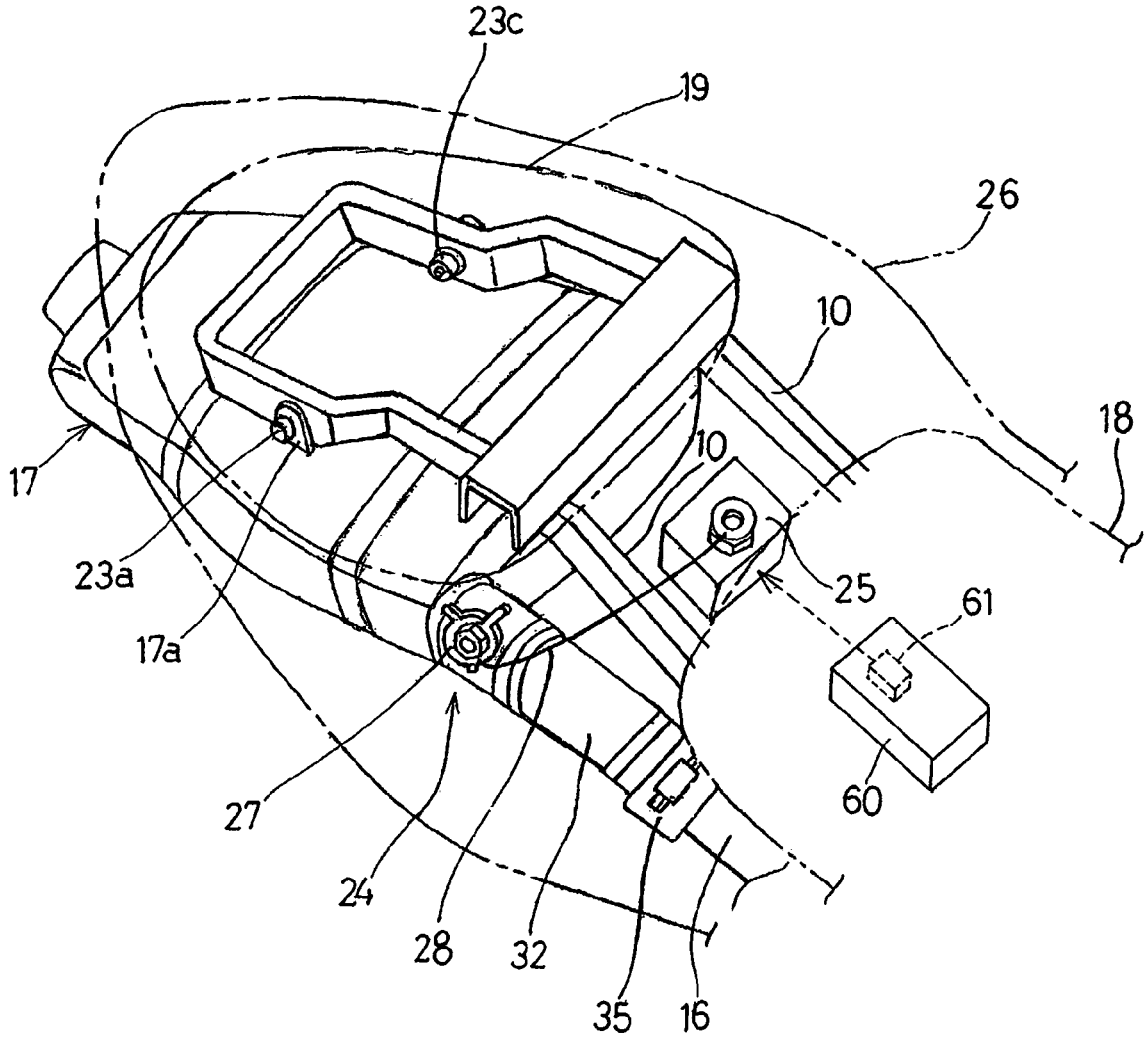
FIG. 4 is a fragmentary perspective view, showing a portion in which the silencer is supported and arranged.

As shown in FIG. 4, the silencer 17 so supported by the seat rails 10 in the manner described above, is positioned below the fellow passenger's seat 19 and the exhaust control valve 24 provided at the inlet of the silencer 17 is positioned laterally outwardly of one of the seat rails 10, for example, right side of the right seat rail 10, at a location adjacent a front portion of the fellow passenger's seat 19. An actuator 25 for driving the exhaust control valve 24 is arranged below a seat assembly having the driver's and fellow passenger's seats 18 and 19, and between these seats 18 and 19. The actuator 25 is positioned substantially in alignment with the longitudinal axis of the motorcycle frame structure FR, and fitted to the seat rails 10. Accordingly, the exhaust control valve 24 and the actuator 25 are positioned nearby relative to each other.

Figure 5:
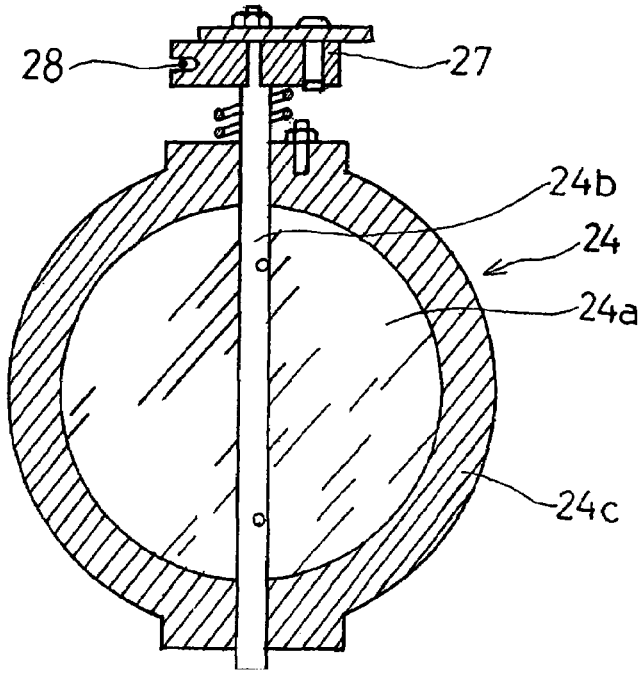
FIG. 5 is a transverse sectional view of an exhaust control valve employed in the exhaust system of the present invention.

The exhaust control valve 24 is preferably in the form of a butterfly valve and includes, as shown in FIG. 5, a valve body 24*a* rotatable within a valve casing 24*c* forming the exhaust passage about a vertical axis and having a valve spindle 24*b* movable together with the valve body 24*a* and having an upper end extending outwardly through an upper portion of the valve casing 24*c*, and a pulley 27 rigidly mounted on the outwardly protruding upper end of the valve spindle 24*b*. The pulley 27 is drivingly connected with the actuator 25 shown in FIG. 4, through a cable wire 28, which is an example of a drive transmitting member. The actuator 25 when driven in response to a signal fed from a control unit 60 causes the valve body 24*a* in FIG. 5 to turn about the valve spindle 24*b*, that is aligned with the vertical axis, so that the exhaust control valve 24 can assume a predetermined opening. In this way, the sectional area of the exhaust passage can be adjusted to any desired value. It is to be noted that in place of the butterfly valve, a rotary valve may be employed for the exhaust control valve 24.

Referring to FIG. 1 and FIG. 4, a tail fairling 26 covering a rear portion of the frame structure FR beneath the passenger's seat 19 is fitted to respective rear end portion of the seat rails 10 and 10, that is, a portion of the seat rails 10 and 10 where the fellow passenger's seat 19 is mounted, so as to cover upper and lateral regions of the exhaust control valve 24. Accordingly, the exhaust control valve 24 is concealed by the tail fairling 26 from the outside to thereby improve the appearance. This tail fairling 26 covers not only the exhaust control valve 24 in the manner described previously, but also the actuator 25 and the cable wire 28 both positioned in the neighborhood of the exhaust control valve 24. Accordingly, when the driver's seat 18 and the fellow passenger's seat 19 are mounted on the motorcycle frame structure FR, neither the exhaust control valve 24 nor the actuator 25 is visible from the outside, thereby providing an appealing appearance.

Figure 6:
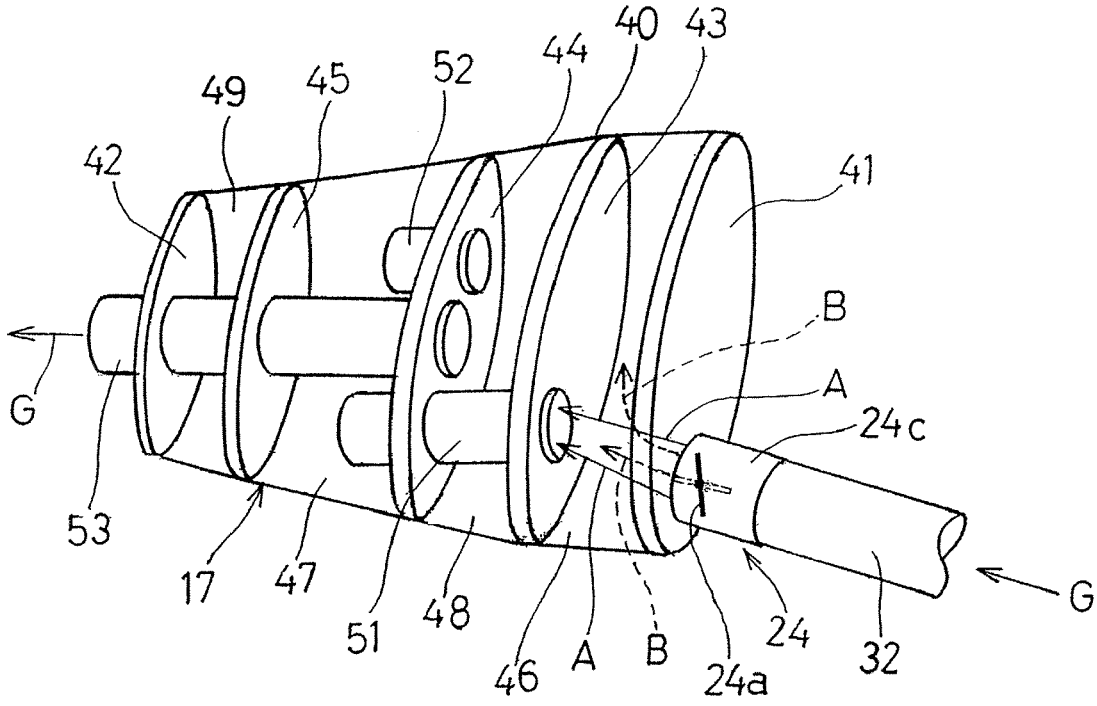
FIG. 6 is a transparent perspective view, showing inside structures of the silencer and the exhaust control valve.

FIG. 6 illustrates the interior structure of the silencer 17 and the exhaust control valve 24. As shown therein, the silencer 17 is of a generally oval tubular configuration including a tubular wall 40 and opposite end walls 41 and 42. The interior of the silencer 17, delimited by the tubular wall 40 and the opposite end walls 41 and 42 is divided into a first expansion chamber 46, a second expansion chamber 47 and a third expansion chamber 48. The first expansion chamber 46 is positioned upstream in the silencer 17 with respect to the direction of flow of the exhaust gas G to the atmosphere and is delimited between the end wall 41 and a first partition wall 43; the second expansion chamber 47 is positioned downstream in the silencer 17 and is delimited between second and third partition walls 44 and 45; and the third expansion chamber 48 is positioned intermediate between the first and second expansion chambers 46 and 47 and delimited between the first and second partition walls 43 and 44.

The first and second expansion chambers 46 and 47 are communicated with each other through a first pipe 51, which forms a first connecting passage; the second expansion chamber 47 and the third expansion chamber 48 are communicated with each other through a second pipe 52, which forms a second connecting passage; and the third expansion chamber 48 is communicated with the outside through a third pipe 53, which forms a third connecting passage. A heat insulating chamber 49 is also defined between the third partition wall 45 and the rear end wall 42 within the interior of the silencer 17. The valve body 24*a* of the exhaust control valve 24 is positioned forwardly of an inlet of the first pipe 51 with an outlet of the exhaust control valve 24 facing towards the inlet of the first pipe 51.

As hereinbefore mentioned, the exhaust control valve 24 can be set to any desired opening by a valve opening adjuster means including the pulley 27 and the actuator 25 shown in FIG. 4. In other words, the operation of the actuator 25 is so controlled by a valve controller 61, built in a control unit 60, as to allow the exhaust control valve 24 to attain an optimum opening by detecting the number of revolutions of the motorcycle combustion engine or an engine speed, the opening of a throttle valve for controlling the engine power and the position of a motorcycle transmission during the operation of the motorcycle. For example, where the number of revolutions of the motorcycle combustion engine is low and, at the same time, the throttle opening is at a minimum value, the valve controller 61 controls the actuator 25 so as to close the exhaust control valve 24, but where the number of revolutions of the motorcycle combustion engine is high and, at the same time, the throttle opening is at a maximum value, the valve controller 61 controls so as to open the exhaust control valve 24. However, where the number of revolutions of the combustion engine and the throttle opening are of a value intermediate between the high and low values and of the minimum and maximum values, respectively, the valve controller 61 controls so as to set the exhaust control valve 24 to a generally intermediate opening. Also, where the motorcycle transmission is set to a high gear position, the actuator 61 controls so as to open the exhaust control valve 24. This control unit 60 is supported by the seat rails 10 at a position below, for example, the driver's seat 18.

It is, however, to be noted that as a signal inputted to the valve controller 61, a signal indicative of the number of revolutions of the motorcycle combustion engine and a signal indicative of the throttle opening can be employed and a signal indicative of the position of the motorcycle transmission can be dispensed with.

With the exhaust system so constructed as hereinbefore described, the exhaust gases G emitted from the exhaust ports 13 of the motorcycle combustion engine E flow into the manifold 15 through the respective exhaust tubes 14. The exhaust gases G merged within the manifold 15 are subsequently emitted to the atmosphere through the joint pipe 16 and the silencer inlet pipe 32, and then through the silencer 17 supported above the motorcycle rear wheel 9. At this time, since the silencer 17 is supported above the motorcycle rear wheel 9, a distance provided between the silencer 17 and the motorcycle combustion engine E is increased and accordingly, the exhaust passage reaching the inlet of the silencer 17 extends a distance greater than that in the conventional exhaust system, in which the silencer 17 is supported laterally outwardly of the motorcycle rear wheel. Since the exhaust passage employed in the exhaust system is relatively long, the temperature of the exhaust gas within the exhaust passage is decreased by the time when they flow to the inlet of the silencer 17 due to heat radiation and accordingly, undesirable influences by the exhaust gas on the exhaust control valve 24 installed at the inlet of the silencer 17 can advantageously be lessened.

It is to be noted that if the joint pipe 16 forming a part of the exhaust passage is employed in the form of a tubular member having a thin wall cooling of the exhaust gases G flowing through the joint pipe 16 can be facilitated due to enhanced heat radiation. On the other hand, if the joint pipe 16 is employed in the form of a tubular member having a thick wall with a consequent large heat capacity, the exhaust gas temperature can be lowered due to heat absorption by the joint pipe 16.

Also, since the exhaust control valve 24 is supported above the motorcycle rear wheel 9, that is, installed at the inlet of the silencer 17 that is arranged in the rear portion of the motorcycle frame structure FR, and is separated a substantial distance from the motorcycle combustion engine E, transmittance of vibrations induced by the combustion engine E to the exhaust control valve 24 is suppressed and, therefore, the exhaust control valve 24 will hardly be affected by the vibrations adversely. Also, the exhaust control valve 24 will not undergo great thermal expansion even when thermally affected by the exhaust gas G. As a result, the valve clearance can be made small and the required valve clearance can easily be secured.

As hereinabove described, the exhaust gases G emitted from the exhaust ports 13, subsequently merges within the manifold 15 through the exhaust tubes 14 and finally the merged exhaust gas G flows into the silencer inlet pipe 32 through the joint pipe 16. Thereafter, the exhaust gas G is diverted corresponding to the opening of the exhaust control valve 24. Referring to FIG. 6, for example, when the valve body 24*a* of the exhaust control valve 24 is set to a substantially closed position during the low speed operating condition, the exhaust gas G flows, as indicated by the arrow A, at a high velocity through a clearance around the periphery of the valve body 24*a* within the valve casing 24*c*. A major portion of the exhaust gas G then flowing at a high velocity through the clearance subsequently flows into the second expansion chamber 47 through the first pipe 51 having an inlet positioned rearwardly of the valve body 24*a*, and are then exhausted to the atmosphere after having flowed through the second expansion chamber 47 and then through the third expansion chamber 48. In other words, no expansion of the exhaust gas G occurs within the first expansion chamber 46. As a result, the engine output can be increased at the low speed operating condition of the motorcycle combustion engine E.

On the other hand, when the valve body 24*a* of the exhaust control valve 24 is set to the full open position as shown by the double-dotted line, a major portion of the exhaust gas G flows at a low velocity into the first expansion chamber 46 as shown by the dotted arrow B and, then, into the third expansion chamber 48 by way of the second expansion chamber 47 before they are exhausted to the atmosphere through the third pipe 53. Accordingly, exhaust noise tending to occur during the high speed rotation of the motorcycle combustion engine E can be sufficiently reduced. Also, when the valve body 24*a* is pivoted to a position where the exhaust control valve 24 assumes the generally intermediate opening, a portion of the exhaust gas flows directly from the silencer inlet pipe 32 into the second expansion chamber 47 through the first pipe 51 as shown by the arrow A, while the remaining portion of the exhaust gases G flows into the first expansion chamber 46 as shown by the arrow B. Accordingly, increase of the output of the motorcycle combustion engine and reduction of the noise induced by the flow of the exhaust gas G can be feasibly balanced. It is to be noted that by changing the relative position between the first pipe 51 and the exhaust control valve 24, the engine output performance can be controlled as desired.

Considering that the actuator 25 shown in FIG. 4 is positioned in a lower region between the front and rear sheets 18 and 19, the actuator 25 can be positioned at a location near the exhaust control valve 24 and, therefore, the cable wire 28, which is a drive transmitting member connecting between the actuator 25 and the exhaust control valve 24, can have a reduced length, resulting in reduction in weight and also in cost.

In addition, reduction in length of the cable wire 28 simplifies the placement of such cable wire 28, accompanied by increase of the assemblability. Also, since reduction in length of the cable wire 28 brings about an improvement in precision of the length thereof, the precision of the valve clearance of the exhaust control valve 24 and the response in selective opening and closure of the exhaust control valve 24 can advantageously be increased. Yet, the disposition of the actuator 25 below the motorcycle seats 18 and 19 results in the actuator 25 held distant from the motorcycle combustion engine E, making it hard for the vibrations of the combustion engine E to be transmitted to the actuator 25. Accordingly, as the drive transmitting member drivingly connecting between the actuator 25 and the exhaust control valve 24, a link mechanism, which is substantially free from a play, can advantageously and conveniently be employed in place of the cable wire 28, resulting in further increase of the response in selective opening and closure of the exhaust control valve 24.

Although the present invention has been fully described in connection with the preferred embodiment thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A motorcycle exhaust system, which comprises:

a motorcycle combustion engine mounted on a motorcycle frame structure at a location generally intermediate between front and rear wheels;

an exhaust passage fluidly connected at one end with an exhaust port of the motorcycle combustion engine;

a silencer disposed at the opposite end of the exhaust passage and supported by the motorcycle frame structure at a location generally above the rear wheel and having a plurality of expansion chambers including a first expansion chamber defined upstream in the silencer with respect to a direction of a flow of an exhaust gas and a second expansion chamber defined downstream in the silencer with respect to the direction of the flow of the exhaust gas;

a first connecting passage communicating between the first and second expansion chambers;

an exhaust control valve disposed in an inlet of the silencer for variably adjusting the sectional area of the exhaust passage and being disposed forwardly of an inlet of the first connecting passage so as to face towards the inlet of the first connecting passage;

a throttle valve; and a valve controller for controlling the exhaust control valve in dependence on at least the number of revolutions of the motorcycle combustion engine and the opening of the throttle valve;

wherein the inlet portion of the silencer is formed by a silencer inlet pipe and the first connecting passage is formed by a first pipe, wherein an outlet of the silencer inlet pipe and an inlet of the first pipe forming the inlet of the first connecting passage occupy respective positions separate to each other within the first expansion chamber, and wherein the valve controller controls the exhaust control valve to be set to a substantially closed position during a low speed operating condition so as to lead a major portion of the exhaust gas into the second expansion chamber through the first pipe at a high velocity without expanding within the first expansion chamber, and to be set to the full open position during a high speed operating condition so as to lead a major portion of the exhaust gas into the first expansion chamber at a low velocity.

2. The motorcycle exhaust system as claimed in claim 1, wherein upper and lateral regions of the exhaust control valve is covered by a tail fairling covering a rear portion of the motorcycle frame structure.

3. The motorcycle exhaust system as claimed in claim 1, further comprising an actuator for driving the exhaust control valve and disposed at a location below a motorcycle seat assembly.

4. The motorcycle exhaust system as claimed in claim 1, wherein the exhaust control valve is employed in the form of a butterfly valve.

5. The motorcycle exhaust system as claimed in claim 4, wherein the exhaust control valve includes a valve member rotatable about a vertical axis.

6. The motorcycle exhaust system as claimed in claim 1 wherein during the low speed operating condition the major portion of the exhaust gas flows directly from the outlet of the silencer inlet pipe to the inlet of the first pipe without obstruction.

7. A motorcycle exhaust system, which comprises:

a motorcycle combustion engine mounted on a motorcycle frame structure at a location generally intermediate between front and rear wheels;

an exhaust passage fluidly connected at one end with an exhaust port of the motorcycle combustion engine;

a silencer disposed at the opposite end of the exhaust passage and supported by the motorcycle frame structure at a location generally above the rear wheel and having a plurality of expansion chambers including a first expansion chamber defined upstream in the silencer with respect to a direction of a flow of an exhaust gas, a second expansion chamber defined downstream in the silencer with respect to the direction of the flow of the exhaust gas, and a third expansion chamber defined in between the first expansion chamber and the second expansion chamber;

a first connecting passage communicating between the first and second expansion chambers going through the third expansion chamber, but not allowing any exhaust gas to escape into the third expansion chamber; and an exhaust control valve disposed in an inlet of the silencer for variably adjusting the sectional area of the exhaust passage, wherein the gas flows in an order from the first expansion chamber to the second expansion chamber to the third expansion chamber, and wherein the exhaust control valve is disposed forwardly of an inlet of the first connecting passage communicating between the first and second expansion chambers so as to face towards the inlet of the first connecting passage.

8. The motorcycle exhaust system as claimed in claim 7, wherein upper and lateral regions of the exhaust control valve is covered by a tail fairling covering a rear portion of the motorcycle frame structure.

9. The motorcycle exhaust system as claimed in claim 7, further comprising an actuator for driving the exhaust control valve and disposed at a location below a motorcycle seat assembly.

10. The motorcycle exhaust system as claimed in claim 7, wherein the exhaust control valve is employed in the form of a butterfly valve.

11. The motor cycle exhaust system as claimed in claim 7 wherein the exhaust control valve includes a valve member rotatable about a vertical axis.

12. The motorcycle exhaust system as claimed in claim 7, further comprising a valve controller for controlling the exhaust control valve in dependence on at least the number of revolutions of the motorcycle combustion engine and the opening of a throttle valve.

13. The motorcycle exhaust system as claimed in claim 12, wherein the valve controller controls the exhaust control valve to be set to a substantially closed position during a low speed operating condition so as to lead a major portion of the exhaust gas into the second expansion chamber through the first pipe at a high velocity without expanding within the first expansion chamber, and to be set to the full open position during a high speed operating condition so as to lead a major portion of the exhaust gas into the first expansion chamber at a low velocity.

14. The motorcycle exhaust system as claimed in claim 7 further comprising a second connecting passage communicating between the second and third expansion chamber.

15. The motorcycle exhaust system as claimed in claim 13 wherein during the low speed operating condition the major portion of the exhaust gas flows directly from the outlet of the silencer inlet pipe to the inlet of the first pipe without obstruction.

* * * * *